US005947376A

United States Patent [19]

Moroi et al.

[11] Patent Number: 5,947,376

[45] Date of Patent: Sep. 7, 1999

[54] FLUID FRICTION VEHICLE HEATERS

[75] Inventors: Takahiro Moroi; Takashi Ban; Nobuaki Hoshino; Masahiko Okada; Kenji Takenaka, all of Kariya, Japan

[73] Assignee: Kabushiki Kaisha Toyoda Jidoshokki Seisakusho, Kariya, Japan

[21] Appl. No.: 09/030,243

[22] Filed: Feb. 25, 1998

[30] Foreign Application Priority Data

Feb. 28, 1997 [JP] Japan ..... 9-045608
Jun. 18, 1997 [JP] Japan ..... 9-161510

[51] Int. Cl.[6] ..... B60H 1/02

[52] U.S. Cl. ..... 237/12.3 R; 237/12.3 B; 126/247; 122/26

[58] Field of Search ..... 237/12.3 R, 12.3 B; 122/26; 126/247; 123/142.5 R

[56] References Cited

U.S. PATENT DOCUMENTS 4,974,778 12/1990 Bertling .

5,743,467 4/1998 Ban et al. ..... 237/12.3 R

*Primary Examiner*—Henry A. Bennett
*Assistant Examiner*—Derek S. Boles
*Attorney, Agent, or Firm*—Morgan & Finnegan, L.L.P.

[57] ABSTRACT

A viscous fluid type heater includes a heating chamber for holding viscous fluid and a rotor located in the heating chamber. A holding chamber is located below the heating chamber to communicate with the heating chamber. A plunger, which is actuated by a solenoid, is movable between a forward position for maximizing the volume of the holding chamber and a rearward position for minimizing the volume of the holding chamber. When the plunger is at the forward position, viscous fluid is discharged from the heating chamber to the holding chamber. When the plunger is at the rearward position, viscous fluid is supplied from the holding chamber to the heating chamber. This allows the load of the heater to be removed or reinstated selectively. In an engine-driven vehicle, the engine can thus started without being hindered by the heater.

21 Claims, 5 Drawing Sheets

FLUID FRICTION VEHICLE HEATERS

BACKGROUND OF THE INVENTION

The present invention relates to vehicle heaters that shear viscous fluid with a rotor to generate heat and transmit the heat to a further fluid.

Automobiles are generally provided with hot-water type heaters. In a vehicle having such a heater, engine coolant is heated by the engine. The heater typically has a heater core housed in a duct. The heated coolant is sent to the heater core to warm the passenger compartment. In a diesel engine vehicle or a lean burn engine vehicle, the amount of heat produced by the engine is relatively small. Thus, the amount of heat transmitted to the coolant is small. It is difficult for the coolant to reach a certain temperature such as 80° C. when the amount of heat sent to the heater core is small. Therefore, the heat used to warm the passenger compartment may be insufficient.

To solve this problem, a shearing action heater, which functions as an auxiliary heater, has been proposed. The auxiliary heater is arranged in an engine coolant circulating circuit to heat engine coolant. Japanese Unexamined Patent Publication No. 2–246823 describes a typical shearing action heater. The heater has a housing, which houses a heating chamber and a water jacket (heat exchange chamber), a drive shaft driven by an engine, and a rotor retained in the heating chamber. The rotor rotates integrally with the drive shaft. Viscous fluid (such as high viscosity silicone oil) is contained in the heating chamber. A belt transmission and an electromagnetic clutch connect the engine to the drive shaft. Thus, the engine drives the drive shaft integrally with the rotor. The rotation of the rotor shears the viscous fluid to produce fluid friction and generate heat. The heat raises the temperature of fluid (engine coolant) circulating through the water jacket.

The viscosity of the viscous fluid increases at low temperatures. Thus, when the prior art shearing action heater commences operation (when the engine starts to rotate the rotor) at low temperatures, the high viscosity of the viscous fluid interferes with the smooth rotation of the rotor. In other words, when the heater commences operation under lower temperature conditions, a large load is applied to the engine by way of the rotor, the electromagnetic clutch, and the belt transmission. Therefore, shocks may be produced, slippage may occur in the electromagnetic clutch, or the belt of the belt transmission may slip. These occurrences may produce noise and cause early wear of various components in the auxiliary heater.

SUMMARY OF THE INVENTION

Accordingly, it is an objective of the present invention to provide a vehicle heater that decreases load when the rotation of the rotor is commenced.

To achieve the above objective, the viscous fluid type heater according to the present invention includes a heating chamber for accommodating viscous fluid therein and a rotor located in the heating chamber. The rotor rotates to shear and heat the viscous fluid. A heat exchange chamber is adjacent to the heating chamber. Heat generated in the heating chamber is transferred to the heat exchange chamber and heats circulating fluid passing through the heat exchange chamber. The heater includes an adjuster for adjusting the amount of the viscous fluid in the heating chamber. The adjuster includes a holding chamber located below the heating chamber to communicate with the heating chamber. The holding chamber has a variable volume.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
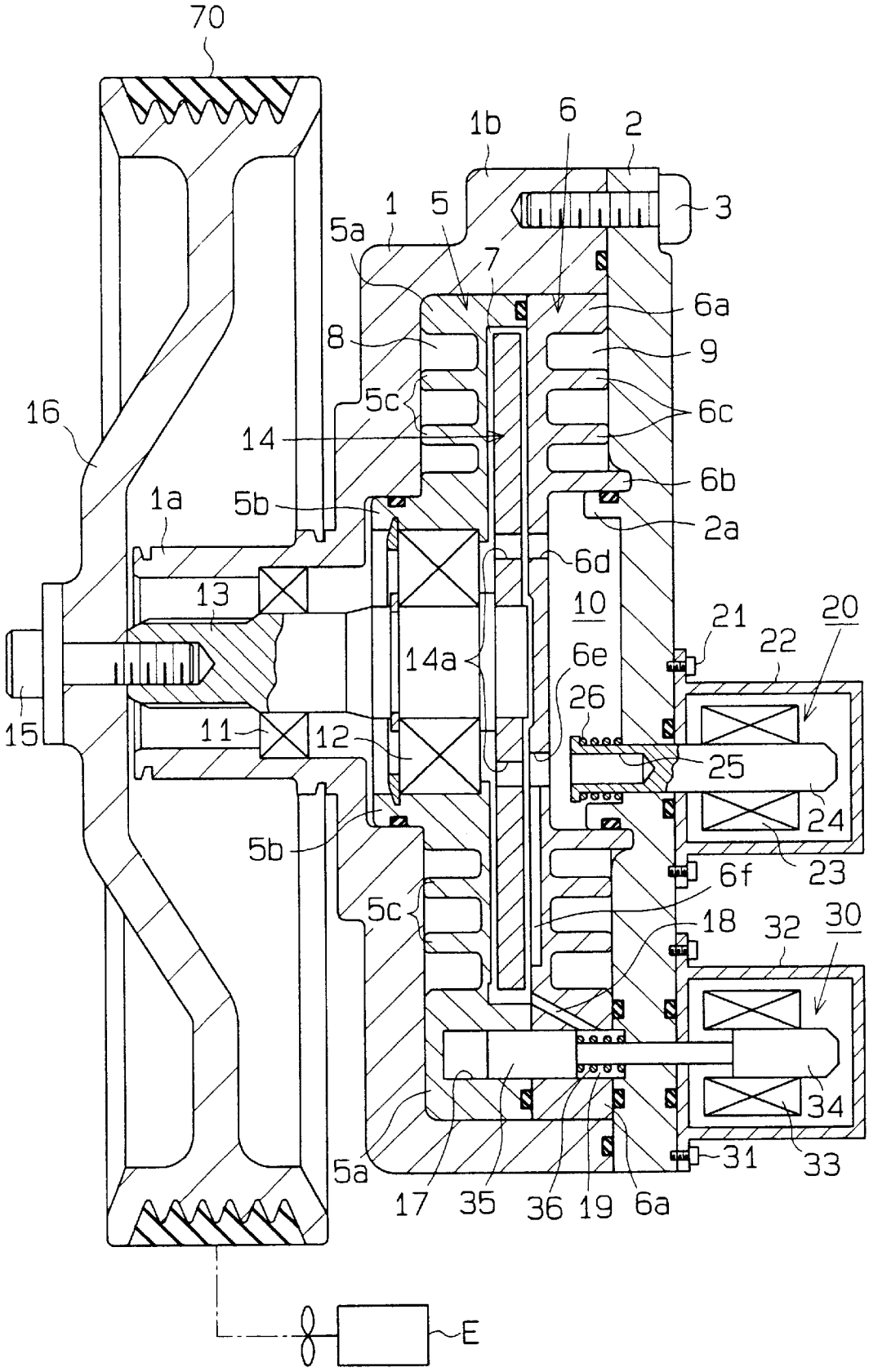
FIG. 1 is a cross-sectional view showing a first embodiment of a heater according to the present invention.

A first embodiment of a heater according to the present invention will now be described with reference to FIGS. 1 to 3. As shown in FIG. 1, the heater has a housing constituted by a front body 1 and a rear body 2. The front body 1 includes a cylindrical, hollow boss 1*a* and a cylindrical case 1*b*. The boss 1*a* extends toward the front of the heater (toward the left as viewed in the drawing) while the case 1*b* extends toward the rear from the boss 1*a*. The rear body 2 closes the case 1*b*. A front plate 5 and a rear plate 6 are arranged in the case 1*b*. The front and rear bodies 1, 2 are fastened to each other by a plurality of bolts 3 (only one shown).

An annular rim 5*a* extends along the periphery of the front plate 5, while an annular rim 6*a* extends along the periphery of the rear plate 6. The rims 5*a*, 6*a* are clamped to one another between the front and rear bodies 1, 2. 25 Thus, the front and rear plates 5, 6 are held in a fixed manner. The rear side of the front plate 5 is hollow to define a heating chamber 7 when the front and rear plates 5, 6 are coupled to each other. Accordingly, the housing of the heater includes the front body 1, the rear body 2, the front plate 5, and the rear plate 6. Each of these housing constituents is made of aluminum or aluminum alloy.

A support hub 5*b* projects from the central portion of the front side of the front plate 5. A plurality of guide fins 5*c* extend concentrically on the front surface of the front plate 5 about the support hub 5*b*. The front plate 5 is fitted in the front body 1 so that part of the support hub 5*b* is in contact with the inner wall of the front body 1. This defines an annular front water jacket 8 between the inner wall of the front body 1 and the front plate 5. The front water jacket 8, which serves as a heat exchange chamber, is adjacent to the front side of the heating chamber 7. Coolant circulates through the front water jacket 8. The flow of the coolant is guided by the rim 5*a*, the support hub 5*b*, and the guide fins 5*c*.

A hub 6*b* projects from the central portion of the rear side of the rear plate 6. A plurality of guide fins 6*c* extend concentrically on the rear surface of the rear plate 6 about the hub 6*b*. The rear plate 6 is fitted in the front body 1 together with the front plate 5 so that the hub 6*b* is in contact with an annular wall 2*a*, which projects from the rear body 2. This defines an annular rear water jacket 9, located between the rear body 2 and the rear plate 6, and a sub-oil chamber 10, located in the hub 6*b*. The rear water jacket 9, which serves as a heat exchange chamber, is adjacent to the rear side of the heating chamber 7. The sub-oil chamber 10 serves as a reservoir chamber. Coolant circulates through the rear water jacket 9. The flow of the coolant is guided by the rim 6*a*, the hub 6*b*, and the guide fins 6*c*.

The front body 1 has a side wall provided with an inlet port (not shown) and an outlet port (not shown) for each water jacket 8, 9. Each water jacket 8, 9 is connected to a vehicle heater circuit (not shown). The coolant circulating through the heater circuit enters each water jacket 8, 9 through the associated inlet port and exits the water jacket 8, 9 through the associated outlet port.

As shown in FIG. 1, a drive shaft 13 extends through the front body 1 and the front plate 5 and is rotatably supported by bearings 11, 12. The bearing 12 is provided with a seal and is arranged between the inner surface of the support hub 5*b* and the outer surface of the drive shaft 13. Thus, the bearing 12 seals the front side of the heating chamber 7.

A pulley 16 is fixed to the front end of the drive shaft 13 by a bolt 15. The pulley 16 is connected to an engine E, which serves as an exterior drive source, by a V-belt 70.

A disk-like rotor 14 is fitted to the rear end of the drive shaft 13 in the heating chamber 7 so that the rotor 14 rotates integrally with the drive shaft 13. The clearance between the surfaces of the rotor 14 and the opposing walls of the heating chamber 7 is, for example, within a range of ten to one thousand microns. A plurality of rotor bores 14*a* extend axially through the central portion of the rotor 14 near the drive shaft 13. The rotor bores 14*a* are arranged at equal distances from the axis of the drive shaft 13 and with equal angles between adjacent bores 14*a*.

The sub-oil chamber 10, which serves as the reservoir chamber, is defined in the region surrounded by the hub 6*b* of the rear plate 6 and the front wall of the rear body 2. Upper and lower communication bores 6*d*, 6*e* extend axially through the rear plate 6. The upper communication bore 6*d* serves as a recovery passage, while the lower communication bore 6*e* serves as a delivery passage. The heating chamber 7 and the sub-oil chamber 10 communicate with each other through the upper and lower communication bores 6*d*, 6*e*. The cross-sectional area of the lower communication bore 6*e* is larger than that of the upper communication bore 6*d*. The upper communication bore 6*d* is located at the same radius as the rotor bores 14*a*. A guide groove 6*f* extends radially through the rear plate 6 from the lower communication bore 6*e*.

Figure 2:
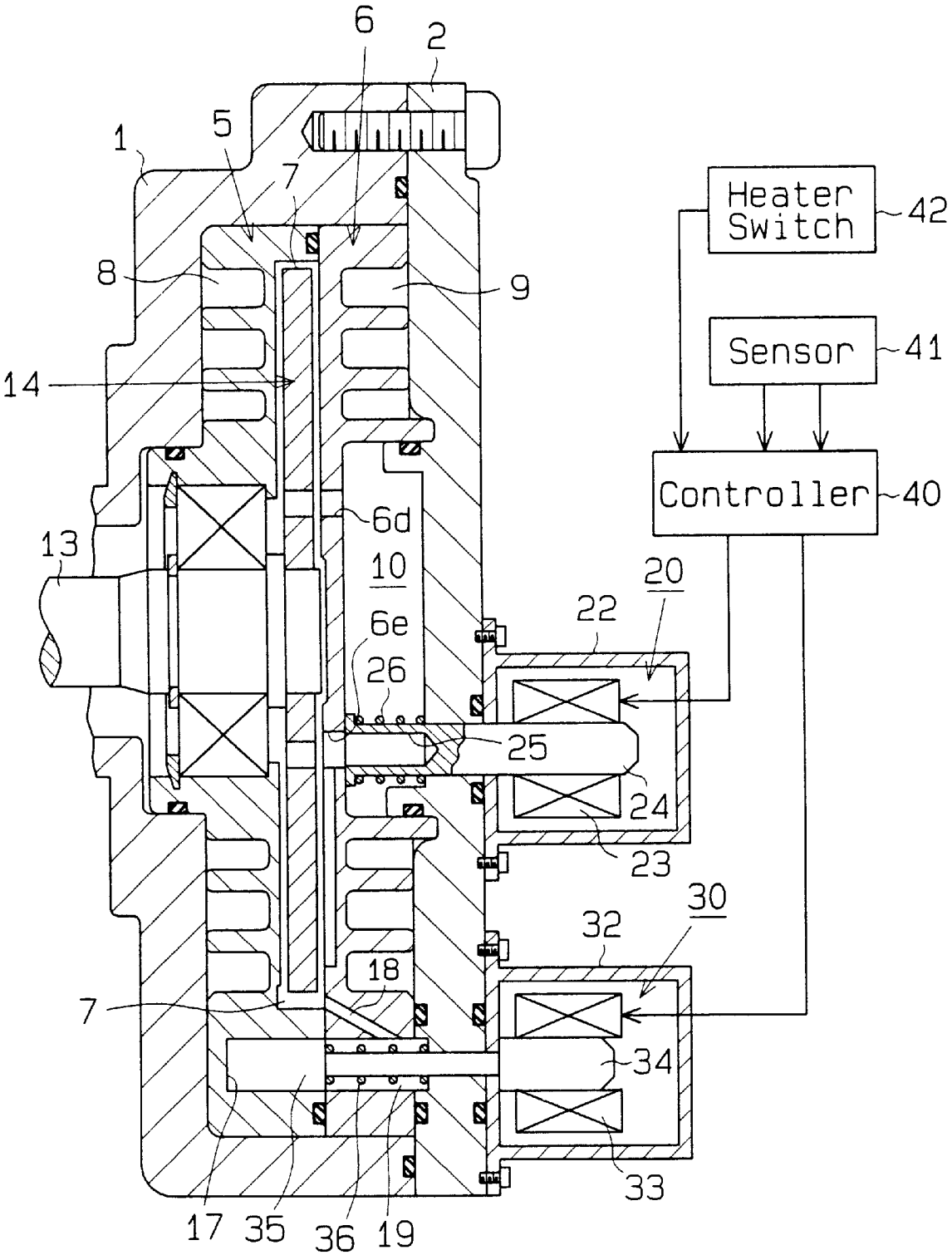
FIG. 2 is a cross-sectional view showing the heater of FIG. 1 in a non-heating state.
Figure 3:
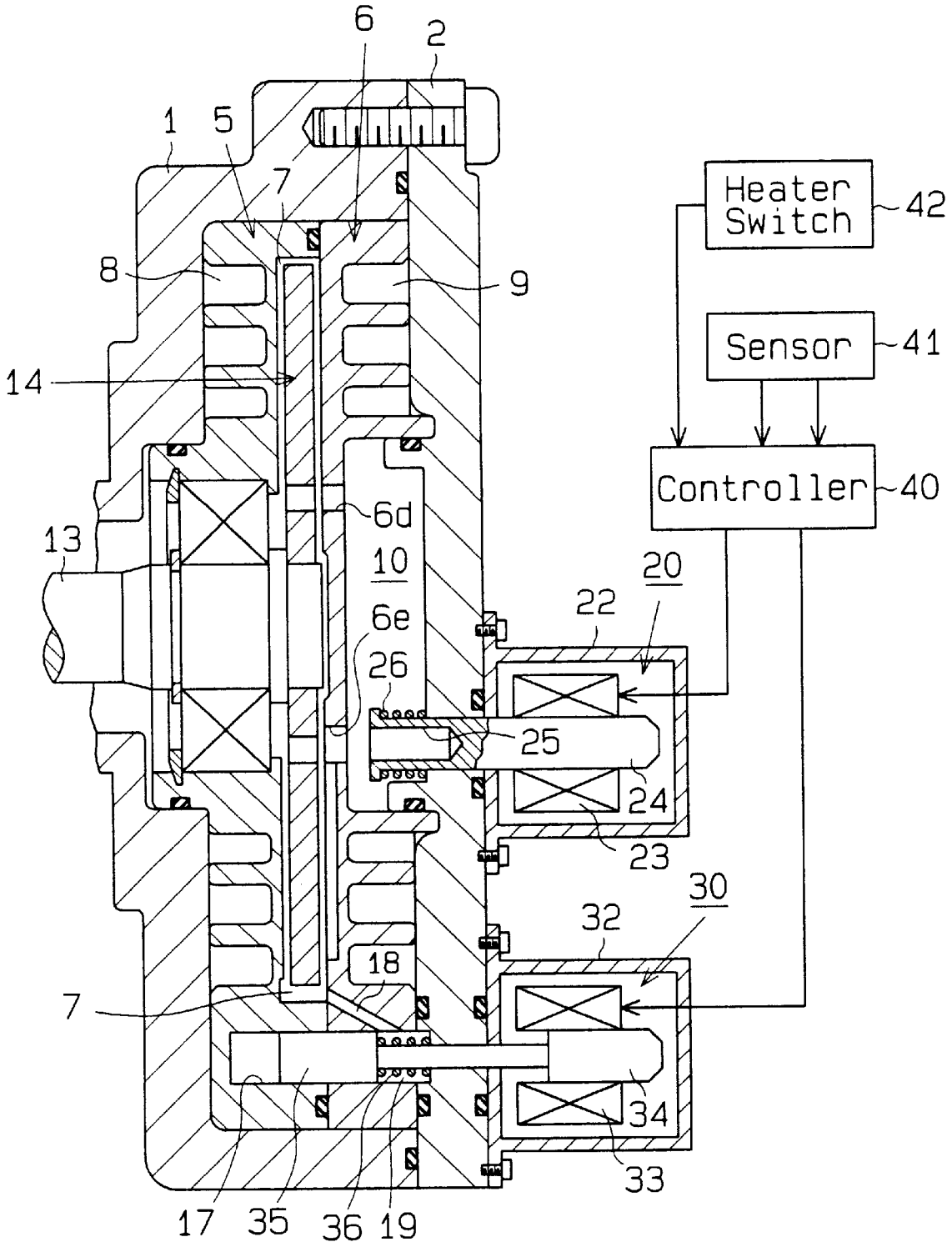
FIG. 3 is a cross-sectional view showing the heater of FIG. 1 in a heating state.

As shown in FIGS. 1 to 3, a first electromagnetic solenoid 20 is attached to the rear body 2. The electromagnetic solenoid 20 is housed in a case 22, which is fastened to the outer surface of the rear body 2 by a plurality of bolts 21. The electromagnetic solenoid 20 includes a solenoid coil 23 and a core 24. The solenoid coil 23 is accommodated in the case 22. The core 24 functions as a valve body and extends through the center of the solenoid coil 23 so that the core 24 slides axially through the rear body 2. The distal end of the core 24 is aligned with the lower communication bore 6*e* in the sub-oil chamber 10. The diameter of the distal end of the core 24 is greater than the diameter of the lower communication bore 6*e* so that the core 24 closes the lower communication bore 6*e*. Accordingly, the core 24 is shifted between an opened position (as shown in FIGS. 1 and 3) and a closed position (as shown in FIG. 2).

A core bore 25 is defined in the distal end of the core 24. The core bore 25 has a circular cross-section. The diameter of the core bore 25 is substantially the same as the diameter of the lower communication bore 6*e*. A coil spring 26, serving as an urging member, is arranged between the distal end of the core 24 and the inner wall of the rear body 2 to urge the core 24 toward the rear plate 6.

As shown in FIG. 1, a cylindrical retaining bore 17 extends through the rim 5*a* of the front plate 5 and the rim 6*a* of the rear plate 6 under the lowermost portion of the heating chamber 7. The retaining bore 17 has a rear portion defined in the rim 6*a* of the rear plate 6. The rear portion of the retaining bore 17 and the bottom portion of the heating chamber 7 are communicated with each other through a communication passage 18, which extends diagonally through the rim 6*a*.

A second electromagnetic solenoid 30 is attached to the rear body 2. The electromagnetic solenoid 30 is housed in a case 32, which is fastened to the outer surface of the rear body 2 by a plurality of bolts 31. The electromagnetic solenoid 30 includes a solenoid coil 33 and a core 34. The solenoid coil 33 is accommodated in the case 32. The core 34 extends through the center of the solenoid coil 33 so that the core 34 slides axially through the rear body 2. The distal end of the core 34 is aligned with the retaining bore 17. A plunger 35 is fixed to the distal end of the core 34.

The plunger 35 has a cross-section that corresponds to the cross-section of the retaining bore 17. Thus, the plunger 35 is axially slidable in the retaining bore 17. A holding chamber 19 extends between the plunger 35 and the inner wall of the rear body 2. The volume of the holding chamber 19 varies in accordance with the movement of the plunger 35. When the core 34 is projected, the plunger 35 is moved to a forward position (refer to FIG. 2). When the core 34 is retracted, the plunger 35 is moved to a rearward position (refer to FIGS. 1 and 3). The holding chamber 19 is always connected to the heating chamber 7 through the communication passage 18 regardless of whether the plunger 35 is located at the forward position or the rearward position. A coil spring 36 serving as an urging member is located between the plunger 35 and the rear body 2 in the holding chamber 19. The coil spring 36 is arranged about the core 34 to urge the plunger 35 and the core 34 forward.

The heating chamber 7, the sub-oil chamber 10, and the holding chamber 19, which communicate with one another, define a sealed space in the heater housing. A predetermined amount of silicone oil, or viscous fluid, is contained in the space. In the state shown in FIG. 1, the silicone oil in the sub-oil chamber 10 is delivered to the heating chamber 7 through the lower communication bore 6*e* and the guide groove 6*f*, while the silicone oil in the heating chamber 7 is sent to and recovered by the sub-oil chamber 10 through the upper communication bore 6*d*. Therefore, the silicone oil is circulated between the heating chamber 7 and the sub-oil chamber 10 during rotation of the rotor 14.

The volume of the holding chamber 19 is maximum when the plunger 35 is located at the forward position and minimum when the plunger 35 is located at the rearward position. The volume of the holding chamber 19 when the plunger 35 is located at the forward position (maximum volume) is set so that the holding chamber 19 accommodates all of the silicone oil that is contained in the heating chamber 7 when the rotation of the rotor 14 is stopped and the plunger 35 is moved to the rearward position.

As shown in FIGS. 2 and 3, a controller 40 is either incorporated in the heater or connected to the heater from a remote location. The controller 40 controls the circulation of the viscous fluid between the heating chamber 7 and the sub-oil chamber 10. The controller 40 also controls the amount of residual viscous fluid in the heating chamber 7. If the controller 40 is to be located at a remote location from the heater, the controller 40 may be incorporated in an electronic control unit (ECU) of the engine E.

The controller 40 is a microcomputer having a central processing unit (CPU), a read only memory (ROM), a random access memory (RAM), and an input/output interface (all not shown). A control program is stored in the ROM. Sensors 41 are connected to the controller 40. The sensors 41 include a temperature sensor for detecting the temperature inside or outside the vehicle, a temperature sensor for detecting the temperature of the fluid circulating through the heater circuit (engine coolant), a temperature sensor for detecting the temperature of the viscous fluid in the heating chamber 7 or the sub-oil chamber 10, and a sensor for detecting the engine speed, and a calculator for calculating the engine speed acceleration.

Each of these sensors 41 outputs data, which represents the detected temperature or engine speed, as analog or digital signals. The controller 40 receives the signals from each sensor 41 and is connected to a heater switch 42 installed in the passenger compartment. A vehicle passenger turns the heater on and off and sets the desired passenger compartment temperature with the heater switch 42. The controller 40 is also connected to the solenoid coils 23, 33 to excite the coils 23, 33 in accordance with the stored programs.

The operation of the heater will now be described. When the engine E is stopped (engine speed: zero rpm), the rotation of the pulley 16, the drive shaft 13, and the rotor 14 are also stopped. In this state, the solenoid coils 23, 33 are de-excited. Thus, as shown in FIG. 2, the force of the coil spring 26 closes the lower communication bore 6*e* with the distal end of the core 24. Furthermore, the force of the coil spring 36 moves the plunger 35 to the forward position. As a result, most of the silicone oil is in the sub-oil chamber 10, the holding chamber 19, which is enlarged, and the communication passage 18. Therefore, there is little or no silicone oil in the heating chamber 7. Since silicone oil, which may hinder the rotation of the rotor 14 when its viscosity is high, is not in the heating chamber 7, the rotor 14 rotates freely. In this state, the pulley 16, the drive shaft 13, and the rotor 14 initiate rotation when the engine E is started. The rotor 14 continues rotating without shearing silicone oil as long as the heater switch 42 is turned off. Since the clearance between the surfaces of the rotor 14 and the walls of the heating chamber 7 is free of silicone oil, heat is not generated. Under such conditions, the surface level of the silicone oil in the sub-oil chamber is located below the upper communication bore 6*d*. The surface level of the silicone oil in the heating chamber 7 is located below the lowermost portion of the rotor 14.

If the heater switch 42 is turned on when the engine E is running, the controller 40 excites the solenoid coils 23, 33 to generate heat with the heater. More specifically, as shown in FIG. 3, the controller 40 excites the upper solenoid coil 23 to produce electromagnetic force and move the core 24 rearward against the force of coil spring 24. This opens the lower communication bore 6*e* and permits the silicone oil in the sub-oil chamber 10 to move into the heating chamber 7. The rearward movement of the core 24 also causes silicone oil to enter the core bore 25. In the meantime, the controller 40 excites the lower solenoid coil 33 to produce electromagnetic force and move the plunger 35 together with the core 34 to the rearward position (FIG. 3) against the force of the coil spring 36. The plunger 35 pushes out the residual silicone oil in the holding chamber 19 into the bottom portion of the heating chamber 7 through the communication passage 18. This raises the surface level of the silicone oil in the heating chamber 7 to a position above the lowermost portion of the rotor 14. Thus, the peripheral portion of the rotating rotor 14 is readily supplied with silicone oil.

For a certain period of time after the lower communication bore 6*e* is opened, the controller 40 repetitively performs the excitation and de-excitation of the upper solenoid coil 23 (e.g., two to ten times). More specifically, the current flow through the upper solenoid coil 23 is stopped immediately after the initial excitation of the upper solenoid coil 23. This eliminates the electromagnetic force and causes the coil spring 26 to force the core 24 forward until the distal end of the core 24 abuts against the rear plate 6, which communicates the core bore 25 with the lower communication bore 6*e*. The abutment stops the movement of the core 24 abruptly and produces inertial force that forces the silicone oil in the core bore 25 into the heating chamber 7 through the lower communication bore 6*e*. The controller 40 moves the core 24 forward and rearward for a predetermined number of times by repeating the excitation and de-excitation of the upper solenoid coil 23 in accordance with the stored program. The continuous reciprocation, or pumping action, of the core 24 pumps silicone oil into the lower communication bore 6*e*. After completion of the pumping action, the excitation of the upper solenoid coil 23 is continued to keep the core 24 at a position opening the lower communication bore 6*e* until the amount of heat generated by the heater reaches the desired level.

During rotation of the rotor 14, the weight and high viscosity of the silicone oil cause the silicone oil in the sub-oil chamber 10 to enter the heating chamber 7 by way of the lower communication bore 6e and the guide groove 6*f*. The pumping action increases the flow rate of the silicone oil drawn into the heating chamber 7 from the sub-oil chamber 10. Thus, the silicone oil is readily and smoothly charged throughout the slight clearance provided between the surfaces of the rotor 14 and the walls of the heating chamber 7. Furthermore, the silicone oil 14 is lifted to the uppermost portion of the rotor 14 within a shorter period of time and the recovery of the silicone oil through the upper communication bore 6*d* begins sooner. Accordingly, the silicone oil in the heating chamber 7 is replaced by the silicone oil from the sub-oil chamber 10 within a short period of time.

The silicone oil filling the clearance between the wall of the heating chamber 7 and the surface of the rotor 14 is sheared and heated. The heat generated in the heating chamber 7 is transmitted to the coolant flowing through the front and rear water jackets 8, 9. The heated coolant is then sent to the heater circuit (not shown) to warm the passenger compartment.

The controller 40 refers to the data sent from the sensors 41 to control the excitation of the upper solenoid coil 23 and feedback control the amount of generated heat as long as the heater switch 42 is turned on and the engine E continues to rotate the pulley 16, the drive shaft 13, and the rotor 14. The amount of generated heat is controlled so that the temperature in the passenger compartment is maintained close to the set temperature value T.

If the temperature in the passenger compartment becomes lower than the set temperature value T, the controller 40 excites the upper solenoid coil 23 to move the core 24 toward the rear and open the lower communication bore 6*e*. Since the diameter of the lower communication bore 6*e* is larger than that of the upper communication bore 6*d*, the amount of silicone oil delivered to the heating chamber 7 becomes greater than the amount of silicone oil recovered from the heating chamber 7. Thus, the silicone oil in the heating chamber 7 increases its amount gradually until entirely filling the clearance between the surfaces of the rotor 14 and the walls of the heating chamber 7. As the amount of silicone oil in the heating chamber 7 increases, the shearing of the silicone oil and thus the amount of generated heat increases.

When the amount of generated heat causes the temperature in the heating chamber 7 to exceed the set temperature value T, the controller 40 de-excites the upper solenoid coil 23 and moves the core 24 forward to close the lower communication bore 6*e*. This stops the silicone oil in the sub-oil chamber 10 from entering the heating chamber 7. In this state, the silicone oil in the heating chamber 7 is recovered through the upper communication bore 6*d*. Thus, the amount of silicone oil in the heating chamber 7 decreases gradually until the rotor 14 starts to rotate freely without shearing the silicone oil. As the amount of silicone oil in the heating chamber 7 decreases, the shearing of the silicone oil and thus the amount of generated heat decreases.

As described above, the amount of generated heat is adjusted by controlling the opening and closing of the lower communication bore 6*e* (delivery passage) with the core 24 (valve body). Accordingly, the upper and lower communication bores 6*d*, 6*e*, the electromagnetic solenoid 20 including the core 24, and the controller constitute a mechanism for controlling the output of the heater.

If the heater switch 42 is turned off when the engine E is running, the controller 42 de-excites the upper solenoid coil 23 and closes the lower communication bore 6*e* with the core 24. This causes a relatively large amount of silicone oil to flow from the heating chamber 7 through the upper communication bore 6*d* into the sub-oil chamber 10 and thus practically stops the generation of heat. The upper communication bore (recovery passage) 6*d* is located in the vicinity of and above the drive shaft 13. Nevertheless, a relatively large amount of silicone oil is recovered by the sub-oil chamber 10 through the upper communication bore 6*d*. This is due to the viscoelasticity of the silicone oil, which causes the silicone oil in the heating chamber 7 to be drawn toward the drive shaft 13 when the rotor 14 is rotating at low speeds. This phenomenon occurs when the Weissenberg effect is superior to the centrifugal force acting on the silicone oil.

When the engine E is stopped, the rotation of the pulley 16, the drive shaft 13, and the rotor 14 are also stopped. If the heater switch 42 remains turned on when the engine E is stopped (rotation of rotor 14 stopped), the controller 40 de-excites the upper solenoid coil 23 and closes the lower communication bore 6*d* with the core 24. The silicone oil located higher than the upper bore 6*d* flows from the heating chamber 7 through the upper communication bore 6*d* into the sub-oil chamber 10 under its own weight.

After a predetermined period of time elapses from the de-excitation of the upper solenoid coil 23 (e.g., three to ten seconds), the controller 40 further de-excites the lower solenoid coil 33. This shifts the plunger 35 to the forward position (refer to FIG. 2) with the force of the coil spring 36. When the plunger 35 reaches the forward position, the volume of the holding chamber 19 becomes maximum. As a result, the weight of the silicone oil and the negative pressure produced when the plunger 35 moves forward draw the residual silicone oil in the heating chamber 7 into the holding chamber 19 through the communication passage 18. Thus, the surface level of the silicone oil in the heating chamber 7 falls lower than the lowermost portion of the rotor 14.

Most of the silicone oil is discharged from the heating chamber 7 in this manner. Accordingly, when the engine E is started again, the rotor 14 is not constrained by the high viscosity silicone oil. Thus, the pulley 16, the drive shaft 13, and the rotor 14 smoothly commence rotation when the engine E is started.

The advantages of the first embodiment will now be described.

Silicone oil is drawn into the holding chamber 19 when the engine E is stopped so that oil does not remain in the heating chamber 7. Thus, when the engine E is started, the rotor 14 is free from the influence of the silicone oil. In other words, the load applied to the pulley 15, the drive shaft 13, and the rotor 14 when commencing rotation is minimized. Accordingly, if the engine E is restarted, shock and noise are not produced. Furthermore, the components of the heater do not wear out early.

When the engine E is stopped with the heater switch 42 turned on, the residual silicone oil in the heating chamber 7 is drawn into the holding chamber 19 to prepare for the restarting of the engine E. Thus, the load produced during restarting of the engine E is minimized regardless of the what condition the engine E is stopped in. Therefore, the V-belt 70, which constitutes a belt transmission, is not likely to slip relative to the pulley 16. This prolongs the life of the V-belt 70.

When the heater commences the generation of heat, the electromagnetic solenoid 20 is repetitively excited to produce the pumping action of the core 24. This pumps the silicone oil reserved in the sub-oil chamber 10 into the heating chamber 10 through the lower communication bore 6*e* before normal circulation of silicone oil between the heating chamber 7 and the sub-oil chamber 10 begins. Accordingly, the heating chamber 7 is smoothly and readily supplied with the necessary amount of silicone oil. Therefore, the desired heat output is rapidly achieved.

The output of the heater is variably controlled by adjusting the amount of silicone oil in the heating chamber 7 during rotation of the rotor 14. The amount of silicone oil is adjusted by controlling the opening and closing of the lower communication bore 6*e* with the core 24. Accordingly, overheating of the silicone oil due to the generation of unnecessary heat is prevented. Therefore, the deterioration of the silicone oil is delayed.

The core bore 25 is provided at the distal end of the core 24. The core bore 25 not only forces the silicone oil into the heating chamber 7 from the sub-oil chamber 10 but also reduces the weight of the core 24. Thus, the light weight of the core 24 reduces the inertial force acting on the core 24. This, in turn, improves the responsiveness of and facilitates the reciprocation of the core 24.

In a further embodiment of a heater according to the present invention, the heater of the first embodiment is modified so that the heating performance of the heater is variably controlled by moving the plunger 35 in cooperation with the core 24. If a decrease in the heat output is the lower solenoid coil 33 is de-excited to move the plunger 35 to the forward position and enlarge the volume of the holding chamber 19. This draws an amount of silicone oil corresponding to the increased volume of the holding chamber 19 into the holding chamber 19 and thus readily decreases the amount of silicone oil in the heating chamber 7. By moving the core 24 in cooperation with the plunger 35, the amount of silicone oil sheared by the rotor 14 is decreased within a short period of time and the amount of heat generated by the heater is rapidly decreased.

In the first embodiment, the core 24 produces a pumping action immediately after the heater initiates the generation of heat. However, in a further embodiment of a heater according to the present invention, the heater of the first embodiment may be modified so that the core 24 also performs the pumping action for a certain period of time (e.g., two to five seconds) whenever the lower communication bore 6*e* is opened. That is, the pumping action is employed anytime the heat output is increased, not just when the heater is started from a cold state. The silicone oil in the sub-oil chamber 10 recovers its original viscoelasticity when a certain period of time elapses after entering the sub-oil chamber 10. Thus, pumping the silicone oil from the sub-oil chamber 10 into the heating chamber 7 rapidly increases the heat output.

A further embodiment of a heater according to the present invention will now be described with reference to FIGS. 4 and 5. Parts that are like or identical to corresponding parts in the first embodiment will be denoted with the same reference numerals. The differing parts will be described below.

Figure 4:
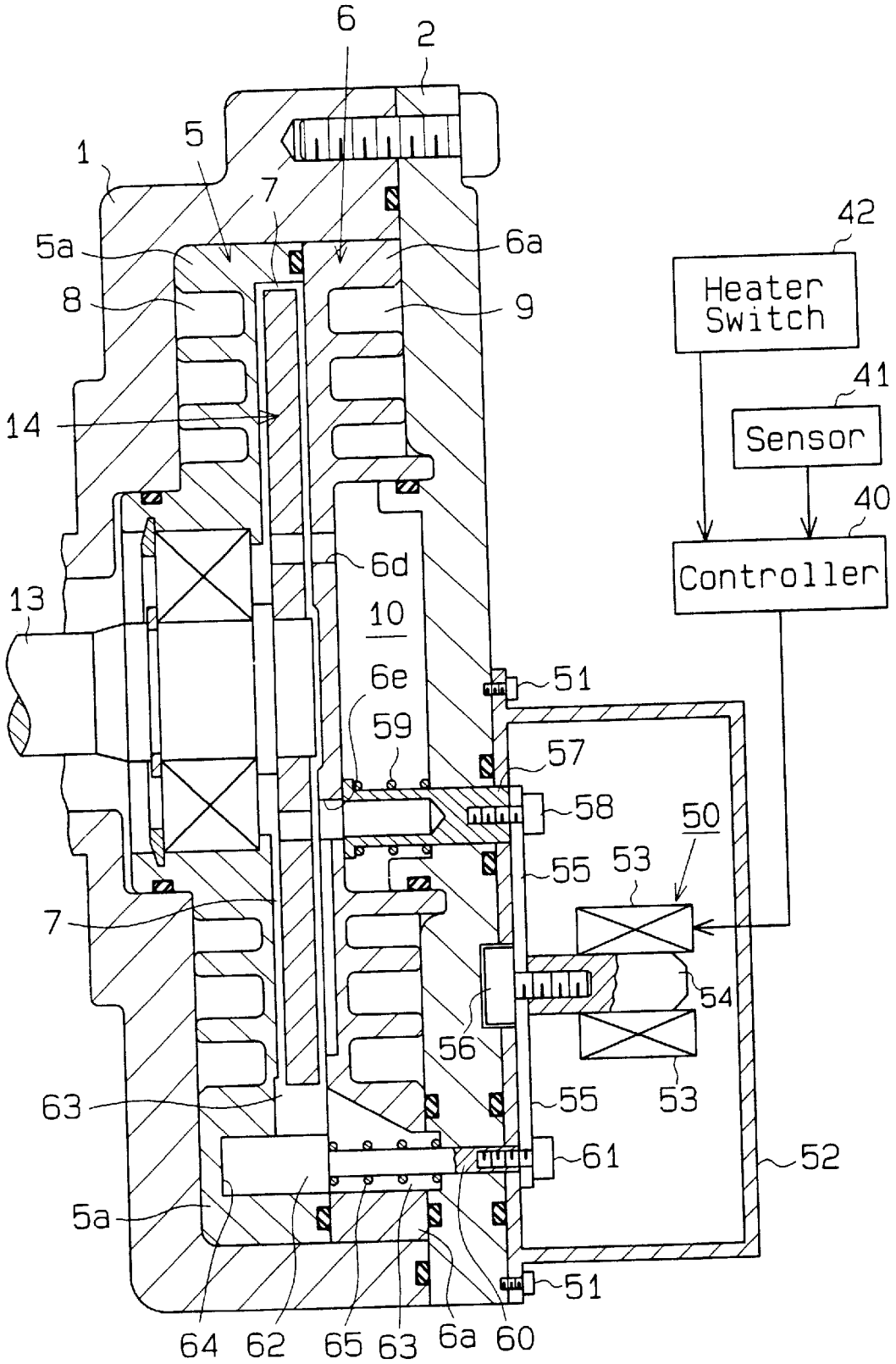
FIG. 4 is a cross-sectional view showing a further embodiment of a heater according to the present invention.
Figure 5:
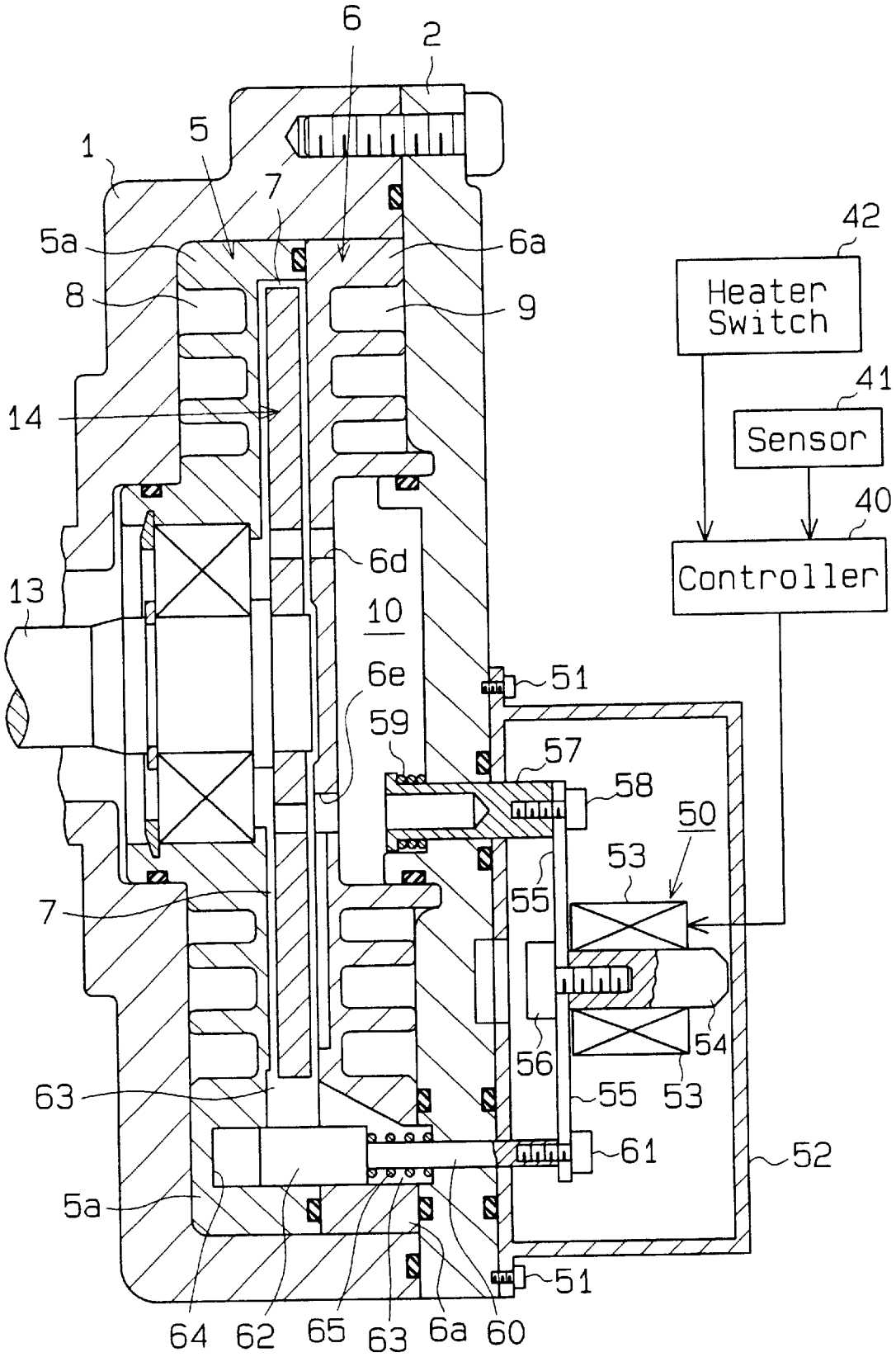
FIG. 5 is a cross-sectional view showing the heater of FIG. 4 in a heating state.

As shown in FIGS. 4 and 5, an electromagnetic solenoid 50 is attached to the rear body 2. The electromagnetic solenoid 50 is housed in a case 52, which is fastened to the outer surface of the rear body 2 by a plurality of bolts 51.

The electromagnetic solenoid 50 includes a solenoid coil 53 and a core 54. The solenoid coil 53 is accommodated in the case 52. The core 54 extends through the center of the solenoid coil 53. A connecting plate 55 is fastened to the distal end of the core 54 by a bolt 56.

An upper rod 57 is fixed to the upper portion of the connecting plate 55 by a bolt 58. The front portion of the upper rod 57 is arranged in the sub-oil chamber 10. A flange is defined at the front end of the upper rod 57. An upper coil spring 59 serving as an urging member is arranged between the flange of the upper rod 57 and the rear wall of the sub-oil chamber 10. The upper coil spring 59 urges the upper rod 57 forward. In the same manner as the upper rod 57, a lower rod 60 is fixed to the lower portion of the connecting plate 55 by a bolt 61. A plunger 62 is coupled to the front end of the lower rod 60. A lower coil spring 65 is arranged between the plunger 62 and the rear body 2 to 25 urge the rod 60 and the plunger 62 forward.

A holding chamber 63 is defined below the heating chamber 7. The holding chamber 63 extends through the rim 5*a* of the front plate 5 and the rim 6*a* of the rear plate 6. The holding chamber 63 includes a retaining bore 64, which is defined in the rim 5*a*. The cross-section of the retaining bore 64 corresponds to that of the plunger 62.

The core 54 is shifted between a rearward position (as shown in FIG. 5) and a forward position (as shown in FIG. 4). The connecting plate 55 connects the upper rod 57 and the lower rod 60 to the core 54. Therefore, the movement of the core 54 shifts the upper core 57 between a position closing the lower communication bore 6*e* and a position opening the lower communication bore 6*e*. The movement of the core 54 also moves the plunger 62 in the retaining bore 64 and varies the volume of the holding chamber 63. The control of the heater is carried out in the same manner as the embodiment illustrated in FIGS. 1 to 3.

The operation of the embodiment shown in FIGS. 4 and 5 will now be described. When the engine E is not running (engine speed: zero rpm), the force of the upper and lower coil springs 59, 65 holds the core 54 at the forward position. In this state, the upper rod 57 closes the lower communication bore 6*e*. The lower rod 60 is located at the forward position. Hence, the volume of the holding chamber 63 is maximum. Furthermore, most of the silicone oil (viscous fluid) is contained in either the sub-oil chamber 10 or the holding chamber 63. Accordingly, the rotor 14 is not constrained by the high viscosity silicone oil and rotates freely.

If the heater switch is turned on when the engine E is running, the controller 40 excites the solenoid coil 53. This shifts the core 54 to the rearward position against the force of the upper and lower coil springs 59, 60. The movement of the core 54 moves the upper rod 57 away from the lower communication bore 6*e* and opens the bore 6*e*. The lower rod 60 is moved to the rearward position to minimize the volume of the holding chamber 63. As a result, the silicone oil in the sub-oil chamber 10 enters the heating chamber 7 and the residuary silicone oil in the holding chamber 63 is pushed out into the bottom portion of the heating chamber 7. Accordingly, the silicone oil is readily delivered to the vicinity of both the central and peripheral areas of the rotating rotor 14.

When the core 54 is moved to the rearward position, the controller repetitively excites and de-excites the solenoid coil 53 for a certain number of times (e.g., two to ten times). This reciprocates the core 54 and produces a pumping action of the upper and lower rods 57, 60. Thus, the silicone oil is readily and smoothly charged throughout the slight clearance between the surfaces of the rotor 14 and the walls of the heating chamber 7. The rotation of the rotor 14 shears the silicone oil and generates heat. Heat exchange takes place between the heated silicone oil in the heating chamber 7 and the circulating coolant flowing through the front and rear water jackets 8, 9. The heated coolant is then sent to the heater circuit (not shown) and used to warm the passenger compartment.

When feedback controlling the amount of generated heat, the controller 40 excites the solenoid coil 53 and moves the core 54 to the rearward position as long as the temperature in the passenger compartment is lower than the set temperature value T. In this state, the lower communication bore 6*e* is left opened by the upper rod 57 and the volume of the holding chamber 63 remains minimum. This increases the amount of silicone oil in the heating chamber 7 and increases the amount of heat generated by the shearing effect. On the other hand, if the heat generated by the heater causes the passenger compartment temperature to exceed the set temperature value T, the controller 40 de-excites the solenoid coil 53 and moves the core 54 to the forward position. This closes the lower communication bore 6*e* with the upper rod 57 and moves the lower rod 60 to enlarge the volume of the holding chamber 63. Thus, the silicone oil in the sub-oil chamber 10 stops entering the heating chamber 7 and the silicone oil in the heating chamber 7 is drawn into either the sub-oil chamber 10 or the holding chamber 63. This decreases the amount of silicone oil in the heating chamber 7 so that the rotor 14 rotates freely without being influenced by the silicone oil. This, in turn, reduces the shearing of the silicone oil and thus the amount of generated heat.

If the heater switch 42 is turned off when the engine E is running, the controller 40 de-excites the solenoid coil 53 and shifts the core 54 to the forward position. The upper rod 57 closes the lower communication bore 6*e* and the lower rod 60 enlarges the volume of the holding chamber 63. This moves the silicone oil in the heating chamber 7 into either the sub-oil chamber 10 or the holding chamber 63 and practically stops the generation of heat.

When the engine E is stopped, the rotation of the pulley 16, the drive shaft 13, and the rotor 14 is also stopped. If the heater switch 42 is turned on when the engine E is stopped (rotation of rotor 14 is also stopped), the controller 40 de-excites the solenoid coil 53 and shifts the core 54 to the forward position. The upper rod 57 closes the lower communication bore 6*e* and causes the silicone oil in the heating chamber 7 to be recovered into the sub-oil chamber 10. Simultaneously, the lower rod 60 enlarges the holding chamber 63. As a result, the weight of the silicone oil and the negative pressure produced when the volume of the holding chamber 63 is enlarged draws the residual silicone oil in the heating chamber 7 into the holding chamber 63. Thus, the surface level of the silicone oil in the heating chamber 7 becomes lower than the lowermost portion of the rotor 14.

Most of the silicone oil is discharged from the heating chamber 7 in this manner. Accordingly, when the engine E is started again, the rotor 14 is not constrained by the high viscosity silicone oil. Thus, the pulley 16, the drive shaft 13, and the rotor 14 smoothly commence rotation when the engine E is started.

Accordingly, the advantages obtained in the embodiment illustrated in FIGS. 1 to 3 are also obtained in this embodiment. Furthermore, in this embodiment, the upper and lower rods 57, 60 are connected to the core 54 by the connecting plate 55. Thus, the rods 57, 60 are operated by the single electromagnetic solenoid 50. This simplifies the structure of the heater and reduces production costs. Furthermore, the single electromagnetic solenoid 50 also simplifies the program used to control the generation of heat.

In the preferred embodiments illustrated in FIGS. 1 to 5, the pulley 16 may be connected to the engine E by way of the belt 70 and a clutch mechanism. The power of the engine is transmitted to the pulley 16 when the heater switch 42 is turned on. If the heater switch 42 is turned off, the clutch mechanism disconnects the pulley 16 from the engine E. In this heater, the rotor 14 smoothly commences rotation without being constrained by the high viscosity silicone oil in the same manner as the preferred and illustrated embodiments. Thus, slippage does not occur in the clutch mechanism.

The viscous fluid is not limited to liquids or semi-viscosity fluids having a high viscosity such as silicone oil and may be any kind of medium that generates heat when the shearing effect of the rotor 14 produces fluid friction.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A viscous fluid type heater comprising:

a heating chamber for accommodating viscous fluid therein;

a rotor located in the heating chamber, wherein the rotor rotates to shear and heat the viscous fluid;

a heat exchange chamber adjacent to the heating chamber, wherein heat generated in the heating chamber is transferred to the heat exchange chamber and heats circulating fluid passing through the heat exchange chamber;

a sub-chamber for containing viscous fluid;

a delivery passage for connecting the sub-chamber to the heating chamber to allow viscous fluid to move into the heating chamber from the sub-chamber;

a recovery passage for connecting the heating chamber to the sub-chamber to allow viscous fluid to move into the sub-chamber from the heating chamber;

a valve body for selectively opening and closing the delivery passage; and a valve actuator for actuating the valve body; and an adjuster for adjusting the amount of the viscous fluid in the heating chamber, wherein the adjuster includes a holding chamber located below the heating chamber to communicate with the heating chamber, the holding chamber having a variable volume.

2. The heater according to claim 1, wherein the adjuster is constructed and arranged to increase the volume of the holding chamber at certain times to transfer viscous fluid from the heating chamber to the holding chamber and to decrease the volume of the holding chamber at certain times to transfer viscous fluid from the holding chamber to the heating chamber.

3. The heater according to claim 2, wherein the adjuster is constructed to increase the volume of the holding chamber such that the surface level of the viscous fluid in the heating chamber falls below the lowermost point on the rotor and to decrease the volume of the holding chamber such that the surface level of the viscous fluid in the heating chamber rises above the lowermost point on the rotor.

4. The heater according to claim 1, wherein the adjuster includes:

a retaining bore located below the heating chamber;

a movable body located in the retaining bore to define the holding chamber in the retaining bore, wherein the movable body is movable between a first position for maximizing the volume of the holding chamber and a second position for minimizing the volume of the holding chamber; and an actuator for moving the movable body, which changes the volume of the holding chamber.

5. The heater according to claim 4, wherein the actuator includes an electromagnetic solenoid, which is selectively excited and de-excited, and wherein the movable body is moved to the second position when the solenoid is excited and is moved to the first position when the solenoid is de-excited.

6. The heater according to claim 1, wherein an external driving source is connected to the rotor for rotating the rotor, wherein the heater further includes a controller for controlling the adjuster, wherein the controller instructs the adjuster to increase the volume of the holding chamber when the external driving source is stopped, and wherein the controller instructs the adjuster to decrease the volume of the holding chamber when the external driving source is running.

7. The heater according to claim 6 further comprising a heater switch, which is selectively turned on and turned off to start and stop the heating action of the heater, wherein the controller instructs the adjuster to decrease the volume of the holding chamber only when the external driving source is running and the heater switch is turned on.

8. The heater according to claim 1, wherein the valve actuator moves the valve body to force viscous fluid into the heating chamber from the sub-chamber.

9. The heater according to claim 8, wherein the valve body is located in the sub-chamber and is movable toward and away from the delivery passage, wherein the heater further includes a controller for instructing the valve actuator to repetitively move the valve body toward and away from the delivery passage for a predetermined period after the valve body has opened the delivery passage.

10. A viscous fluid type heater mounted in a vehicle, wherein the heater is driven by a vehicle engine, the heater comprising:

a heating chamber for accommodating viscous fluid therein;

a rotor located in the heating chamber to be rotated by the engine, wherein the rotor rotates to shear and heat the viscous fluid;

a heat exchange chamber adjacent to the heating chamber, wherein heat generated in the heating chamber is transferred to the heat exchange chamber and heats circulating fluid passing through the heat exchange chamber;

a sub-chamber for containing viscous fluid;

a delivery passage for connecting the sub-chamber to the heating chamber to allow viscous fluid to move into the heating chamber from the sub-chamber;

a recovery passage for connecting the heating chamber to the sub-chamber to allow viscous fluid to move into the sub-chamber from the heating chamber;

a valve body for selectively opening and closing the delivery passage; and a valve actuator for actuating the valve body; and an adjuster for adjusting the amount of the viscous fluid in the heating chamber, wherein the adjuster includes a holding chamber located below the heating chamber to communicate with the heating chamber, the adjuster being constructed and arranged to increase the volume of the holding chamber at certain times to transfer viscous fluid from the heating chamber to the holding chamber and to decrease the volume of the holding chamber at certain times to transfer viscous fluid from the holding chamber to heating chamber.

11. The heater according to claim 10, wherein the adjuster is constructed to increase the volume of the holding chamber such that the surface level of the viscous fluid in the heating chamber falls below the lowermost point on the rotor and to decrease the volume of the holding chamber such that the surface level of the viscous fluid in the heating chamber rises above the lowermost point on the rotor.

12. The heater according to claim 10, wherein the adjuster includes:

a retaining bore located below the heating chamber;

a movable body located in the retaining bore to define the holding chamber in the retaining bore, wherein the movable body is movable between a first position for maximizing the volume of the holding chamber and a second position for minimizing the volume of the holding chamber; and an actuator for moving the movable body, which changes the volume of the holding chamber.

13. The heater according to claim 12, wherein the actuator includes an electromagnetic solenoid, which is selectively excited and de-excited, and wherein the movable body is moved to the second position when the solenoid is excited and is moved to the first position when the solenoid is de-excited.

14. The heater according to claim 12 further comprising a controller for controlling the actuator, wherein the controller instructs the actuator to move the movable body to the first position when the engine is stopped, and wherein the controller instructs the actuator to move the movable body to the second position when the engine is running.

15. The heater according to claim 14 further comprising a heater switch, which is selectively turned on and turned off to start and stop the heating action of the heater, wherein the controller instructs the actuator to move the movable body to the second position only when the engine is running and the heater switch is turned on.

16. The heater according to claim 10, wherein the valve body is located in the sub-chamber and is movable toward and away from the delivery passage, wherein the heater further includes a controller for instructing the valve actuator to repetitively move the valve body toward and away from the delivery passage to force viscous fluid into the heating chamber from the sub-chamber for a predetermined period after the valve body has opened the delivery passage.

17. The heater according to claim 1, wherein the adjuster includes;

a retaining bore located below the heating chamber; and a movable body located in the retaining bore to define the holding chamber in the retaining bore, the movable body being movable between a first position for maximizing the volume of the holding chamber and a second position for minimizing the volume of the holding chamber and further wherein the valve actuator is for moving the movable body to change the volume of the holding chamber.

18. The heater according to claim 17, further comprising an external driving source connected to the rotor for rotating the rotor, and a controller for controlling the valve actuator, the controller instructing the valve actuator to increase the volume of the holding chamber when the external driving source is stopped, and the controller instructing the valve actuator to decrease the volume of the holding chamber when the external driving source is running.

19. The heater according to claim 18, further comprising a heater switch for being selectively turned on and turned off to start and stop the heating action of the heater, respectively, wherein the controller instructs the valve actuator to decrease the volume of the holding chamber only when the external driving source is running and the heater switch is turned on.

20. The heater according to claim 10, wherein the adjuster includes:

a retaining bore located below the heating chamber; and a movable body located in the retaining bore to define the holding chamber in the retaining bore, the movable body being movable between a first position for maximizing the volume of the holding chamber and a second position for minimizing the volume of the holding chamber and further wherein the valve actuator is for moving the movable body to change the volume of the holding chamber.

21. The heater according to claim 20, wherein the valve actuator includes an electromagnetic solenoid for being selectively excited and de-excited, the movable body moving to the second position when the solenoid is excited and the movable body moving to the first position when the solenoid is de-excited.

* * * * *

UNITED STATES PATENT AND TRADEMARK OFFICE

CERTIFICATE OF CORRECTION

PATENT NO. : 5,947,376

DATED : September 7, 1999

INVENTOR(S) : Takahiro Moroi et al.

It is certified that error appears in the above-identified patent and that said Letters Patent is hereby corrected as shown below:

Column 2, line 44, delete "25".

Column 8, line 63, after "is" insert --required ,--

Column 9, line 31, eliminate indent.

Column 9, line 47, delete "25".

Signed and Sealed this

Twenty-fourth Day of October, 2000

*Attest:*

Q. TODD DICKINSON

*Attesting Officer*

*Director of Patents and Trademarks*